US010663245B2

(12) United States Patent
Folk et al.

(10) Patent No.: US 10,663,245 B2
(45) Date of Patent: May 26, 2020

(54) TRIGGER BAR FOR A FIREARM

(71) Applicant: Apex Tactical Specialties, Inc., Peoria, AZ (US)

(72) Inventors: Donald Scott Folk, Litchfield Park, AZ (US); Matthew James Theiss, Glendale, AZ (US)

(73) Assignee: APEX TACTICAL SPECIALTIES, INC., Peoria, AZ (US)

( * ) Notice: Subject to any disclaimer, the term of this patent is extended or adjusted under 35 U.S.C. 154(b) by 0 days.

(21) Appl. No.: 15/660,856

(22) Filed: Jul. 26, 2017

(65) Prior Publication Data

US 2019/0033028 A1 Jan. 31, 2019

(51) Int. Cl.

| | |
|---|---|
| ***F41A 19/10*** | (2006.01) |
| ***F41A 19/32*** | (2006.01) |
| ***F41A 19/11*** | (2006.01) |
| ***F41C 3/00*** | (2006.01) |
| *F41A 17/46* | (2006.01) |

(52) U.S. Cl.

CPC ..... *F41A 19/32* (2013.01); *F41A 19/10* (2013.01); *F41A 19/11* (2013.01); *F41C 3/00* (2013.01); *F41A 17/46* (2013.01)

(58) Field of Classification Search

CPC ..... F41A 17/46; F41A 17/56; F41A 19/10; F41A 19/12

USPC ..... 42/69.01–69.03, 70.04, 70.05, 70.08; 89/147, 148, 139

See application file for complete search history.

(56) References Cited

U.S. PATENT DOCUMENTS

| | | | | |
|---|---|---|---|---|
| 4,589,327 | A * | 5/1986 | Smith | F41A 17/74 42/70.08 |
| 4,726,136 | A * | 2/1988 | Dornaus | F41A 9/53 42/7 |
| 5,086,579 | A * | 2/1992 | Flatley | F41A 17/74 42/69.03 |
| 5,088,222 | A * | 2/1992 | Larson | F41A 17/56 42/70.04 |
| 6,070,512 | A * | 6/2000 | Rohrbaugh | F41A 17/06 42/69.02 |
| 6,588,136 | B2 * | 7/2003 | Baker | F41A 19/48 42/70.02 |
| 7,617,628 | B2 | 11/2009 | Curry | |

FOREIGN PATENT DOCUMENTS

| | | | | |
|---|---|---|---|---|
| EP | 0192343 A2 * | 8/1986 | | F41A 17/72 |

OTHER PUBLICATIONS

Bobapunk, "FNS Trigger Job", Sep. 22, 2014, arl5.com, <https://www.ar15.com/forums/handguns/FNS_Trigger_Job/53-153591/>, Entire Article. (Year: 2014).*

(Continued)

*Primary Examiner* — Jonathan C Weber

(74) *Attorney, Agent, or Firm* — Fitch, Even, Tabin & Flannery LLP

(57) ABSTRACT

A trigger bar for a semi-automatic firearm including a continuous U-shaped body and a single tab extending outward from a base of the U-shaped body. The tab is offset from a centerline located between legs of the U-shaped body. The trigger bar is configured to operate the sear when the legs are coupled to a sear assembly of the firearm, and only the single tab is coupled to a trigger of the firearm via a trigger bar slot of the trigger.

10 Claims, 6 Drawing Sheets

(56) References Cited

OTHER PUBLICATIONS

Bren Ten Owner's Manual Abridged version; Dornaus & Dixon Enterprises, Inc.; 1983; 23 pages.
Bren Ten Wikipedia; https://en.wikipedia.org/wiki/Bren_Ten; Nov. 6, 2018; 5 pages.
YouTube; "Bren Ten: The Most Tactical Pistol!"; Forgotten Weapons; Sep. 30, 2015; https://www.youtube.com/watch?v=A3amzB_hVUw; 2 pages.
YouTube; "CZ 75 detailed disassembly and re-assembly"; Petero; Feb. 18, 2016; https://www.youtube.com/watch?v=C8N1WxXoj2g; 2 pages.

* cited by examiner

TRIGGER BAR FOR A FIREARM

BACKGROUND OF THE INVENTION

Field of the Invention

The present invention relates generally to semi-automatic firearms, and more specifically to trigger assemblies for semi-automatic firearms.

Discussion of the Related Art

Firearms use triggers to initiate the firing of a cartridge in the firing chamber of the weapon. This is accomplished by actuating a striking device (a striker) through a combination of spring and kinetic energy operating through a firing pin to strike and ignite the primer.

In semi-automatic pistols, movement of a sear releases the striker, allowing the striker to contact the firing pin. The sear is in turn rotated by the rearward movement of the trigger. The trigger bar connects the trigger to the sear and translates the rearward movement of the trigger into the rotation of the sear that allows striker to be released, resulting in firing of the pistol.

The trigger is generally connected to the trigger bar via a trigger bar pin which allows the trigger to move with the trigger bar and also allows the trigger bar to rotate around the pin axis.

SUMMARY OF THE INVENTION

Several embodiments of the invention advantageously address the needs above as well as other needs by providing a trigger bar for a semi-automatic firearm comprising: a continuous U-shaped body having a straight connector base portion and two rear legs coupled to and generally perpendicular to the connector base portion, the body having a centerline located equidistantly from each leg, wherein each leg is configured to operatively couple to a sear assembly of the semi-automatic firearm; a single tab oriented generally parallel to the centerline and extending forward from a straight connector base portion at a location offset from the centerline, and configured to be insertable within a trigger bar slot of a trigger of the firearm, the tab including a trigger bar pin hole at an end of the tab distal to the straight connector base portion, the trigger bar pin hole configured to receive a trigger bar pin of the firearm, whereby the trigger bar is functional for firing of the firearm when the only connection of the trigger to the trigger bar is via the trigger bar tab.

In another embodiment, the invention can be characterized as a semi-automatic firearm including: a trigger including a trigger bar slot and a safety slot generally parallel to the trigger bar slot, wherein the trigger bar slot and the safety slot are separated by a wall; a trigger bar pivotally coupled to the trigger, the trigger bar including a generally U-shaped body including generally parallel legs extending rearward and a trigger bar tab extending forward from a base of the U-shaped body at a location offset from a centerline of the trigger bar, the trigger bar tab configured to insertably fit within the trigger bar slot; a sear pivotally coupled to the U-shaped body, whereby actuation of the trigger fires the firearm; and a safety configured to insertably fit within the safety slot.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
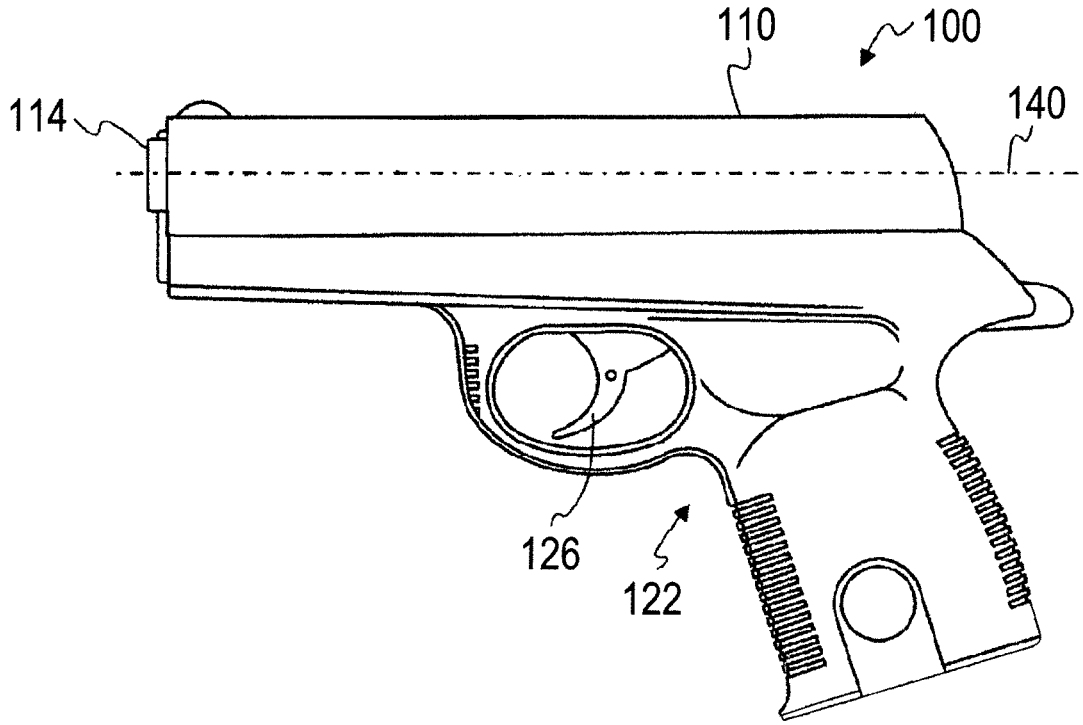
FIG. 1 is a side elevational view of an assembled firearm in accordance with various embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Moreover, many references are made throughout this specification to approximate values and ranges. The terms "approximate" or "about" as used herein are meant simply to account for various tolerances and reasonable variances as may exist in manufacturing and testing procedures as are readily understood by those having skill in the art. For example, reference to an approximate value may inherently include a tolerance or variance of 0.10%, 1%, 5%, 10%, or anything in between, as would be deemed appropriate by one having skill in the relevant art with regard to the specific item or concept to which the value or range pertains.

In the context of this description, directions are oriented with respect to a direction along the firing axis towards the exit portion of a barrel of the firearm being defined as a "frontwards" or "forward" direction. "Rearwards" is understood to mean along the longitudinal axis towards a magazine or grip portion of the firearm. Left and right are defined with respect to looking in the forward direction.

Referring first to FIG. 1, a side elevational view of an assembled firearm 100 is illustrated in accordance with various embodiments. By one approach, the firearm 100 is a semiautomatic handgun or pistol, though the teachings disclosed herein may be applied to any type of firearm 100. Shown are a frame 122, a slide 110, a barrel 114, a trigger 126, and a longitudinal firing axis 140. The barrel 114 is disposed at a front aperture of the slide 110 and is cooperatively linked therewith, and, together with the slide 110, defines the longitudinal firing axis 140. The barrel 114 has a rearward end adapted for receiving a cartridge from the magazine 128. The trigger 126 is pivotally mounted to the frame 122 to actuate a firing mechanism to fire the firearm 100. Often, the frame 122 is fabricated of a high-impact polymer material, metal, a combination of polymer and metal, or the like. The firing mechanism or means is provided for, at least in part, discharging a round of ammunition upon actuation of the trigger 126. The internal components of the firearm 100 are described in more detail below in FIG. 2.

Figure 2:
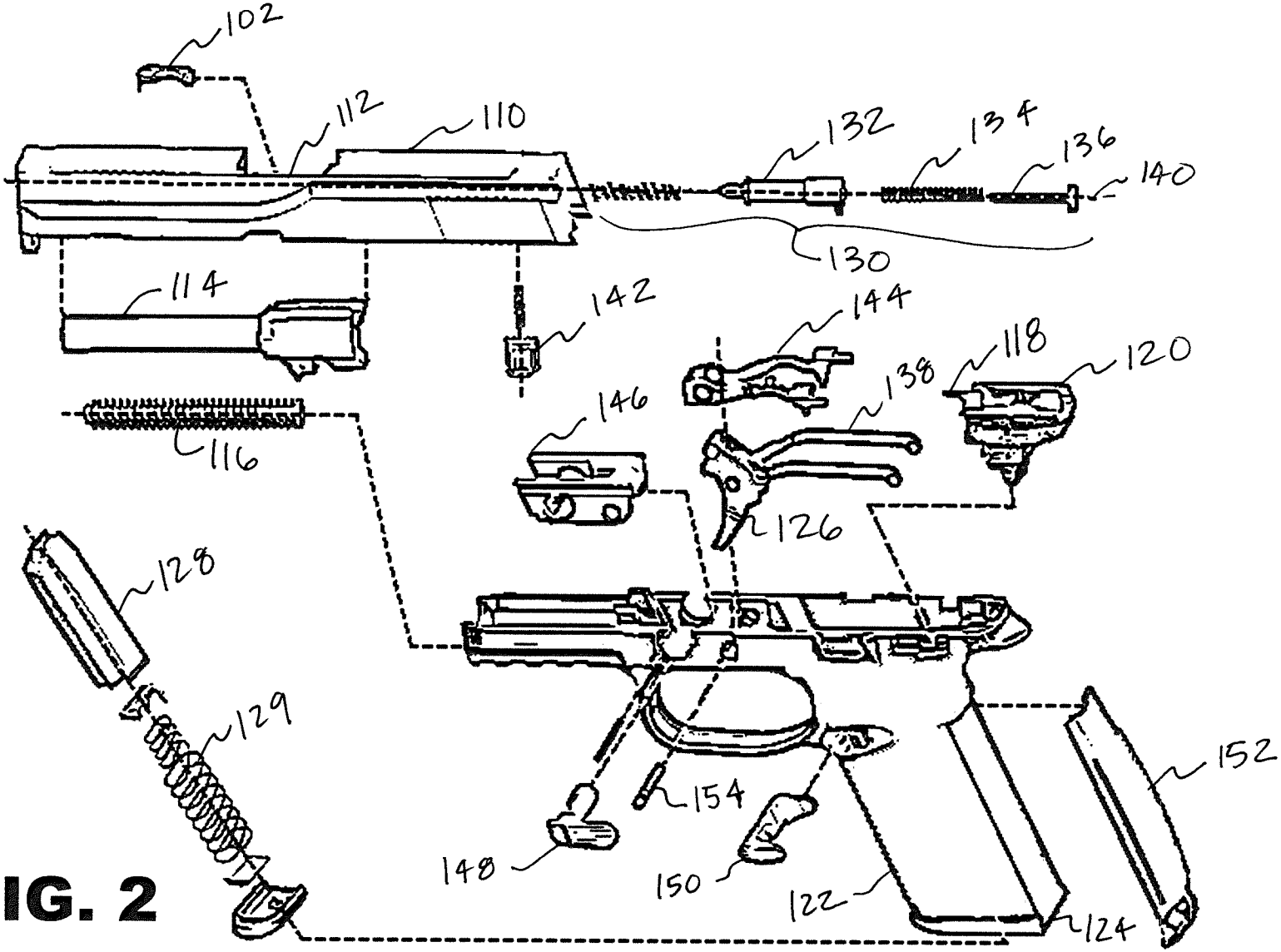
FIG. 2 is an exploded diagram of the firearm shown in accordance with various embodiments.

Referring next to FIG. 2, an exploded diagram of the firearm 100 is shown in accordance with various embodiments. By one approach, the firearm 100 is a semiautomatic handgun or pistol, though the teachings disclosed herein may be applied to any type of firearm 100. The firearm 100 may comprise an extractor 102, the slide 110, an ejection port 112, the barrel 114, a recoil spring 116, an ejector 118, a sear assembly 120, the frame 122, a handle 124, the trigger 126, a trigger bar 138, a magazine 128, a magazine spring 129, a firing axis 140, a striker block 142, a slide stop lever 144, an unlock block 146, a takedown lever 148, a magazine catch 150, a backstrap 152, a trigger pin 154, and a striker assembly 130 possibly including a striker 132, a striker spring 134 and a striker spring guide 136, in addition to other parts, and other components shown or not shown.

The slide 110 is fitted to opposingly positioned rails (not shown) of the frame 122 to effect the reciprocal movement of the slide 110 along the longitudinal firing axis 140. The rails extend along the underside of the slide 110 in the longitudinal direction and are cooperative with the frame 122 to allow the cycling of the slide 110 between forward (battery) and rearward (retired) positions.

The trigger 126 is pivotally connected to the frame 122 via the trigger pin 154. The trigger 126 is also pivotally connected to the trigger bar 138 via a trigger bar pin (not shown). The trigger bar 138 may be biased in lateral directions via a spring or the like. When the trigger 126 is pulled, the trigger moves rearward as it pivots about the trigger pin 154. Rearward movement of the trigger 126 causes movement of the trigger bar 138 in a rearward longitudinal direction. When the trigger 126 is actuated by being pressed in a rearward direction, the trigger 126 pivots about the trigger bar pin, thereby transmitting rearward longitudinal movement to the trigger bar 138 via the trigger bar pin. Longitudinal movement of the trigger bar 138 in a rearward direction, in turn, actuates a sear of the sear assembly 120, thereby allowing the striker 132 to translate in a forward direction under the action of the decompressing striker spring 134 for the striker 132 to engage a cartridge and fire the firearm 100. The connection of the trigger bar 138 to the sear assembly is described further below in FIG. 3.

The general cooperation of the frame 122, the slide 110, the barrel 114, and the firing mechanism during the loading, firing of a cartridge, and ejecting of a spent casing for the firearm 100 of the present type can be understood by referring to U.S. Pat. No. 7,617,628 (Curry) which is incorporated herein by reference.

Figure 3:
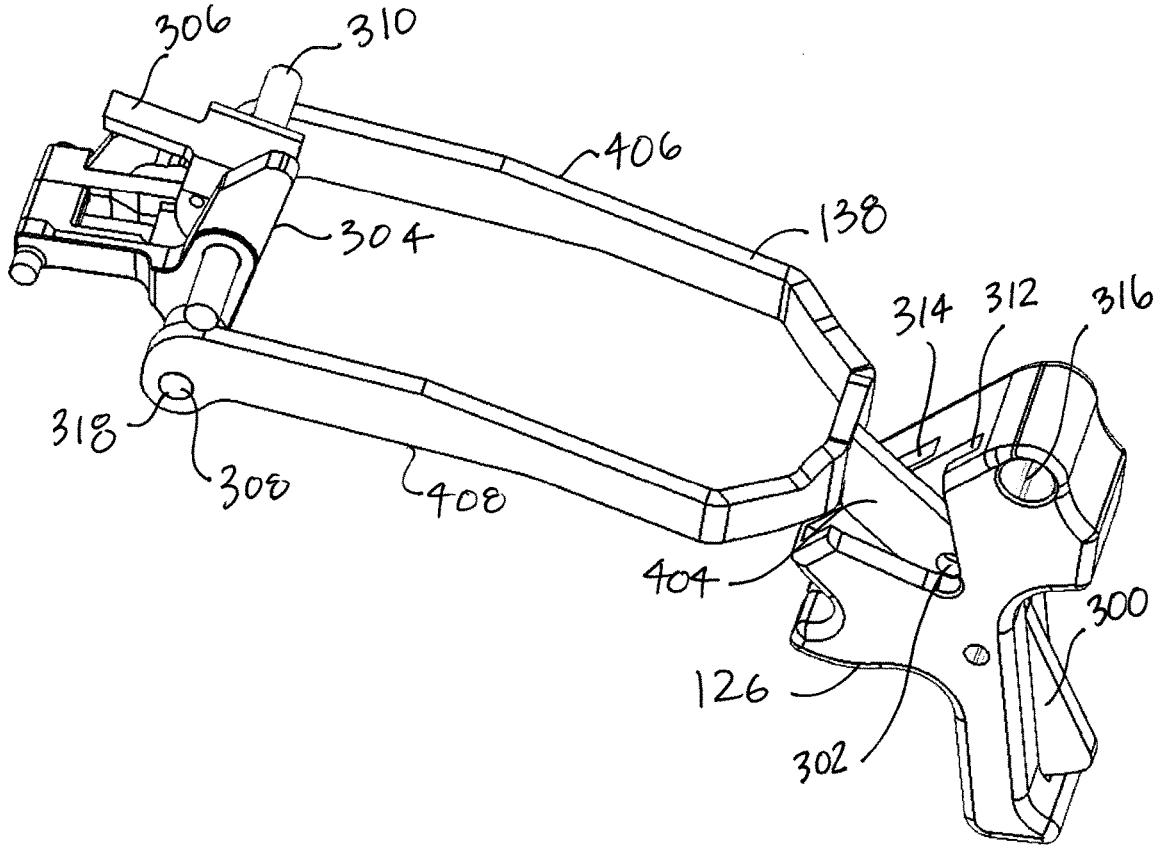
FIG. 3 is a perspective view of a trigger/sear assembly of the firearm in accordance with one embodiment of the present invention.

Referring next to FIG. 3, a perspective view of a trigger/sear assembly is shown in accordance with one embodiment of the present invention. Shown are the trigger 126, the trigger bar 138, a safety 300, a first trigger bar pin hole 302, a sear carrier 304, a sear 306, a first sear carrier pin 308, a second sear carrier pin 310, a trigger bar slot 312, a safety slot 314, a trigger pin hole 316, a sear carrier pin hole 318, a trigger bar tab 404, a trigger bar first leg 406, and a trigger bar second leg 408.

Figure 4:
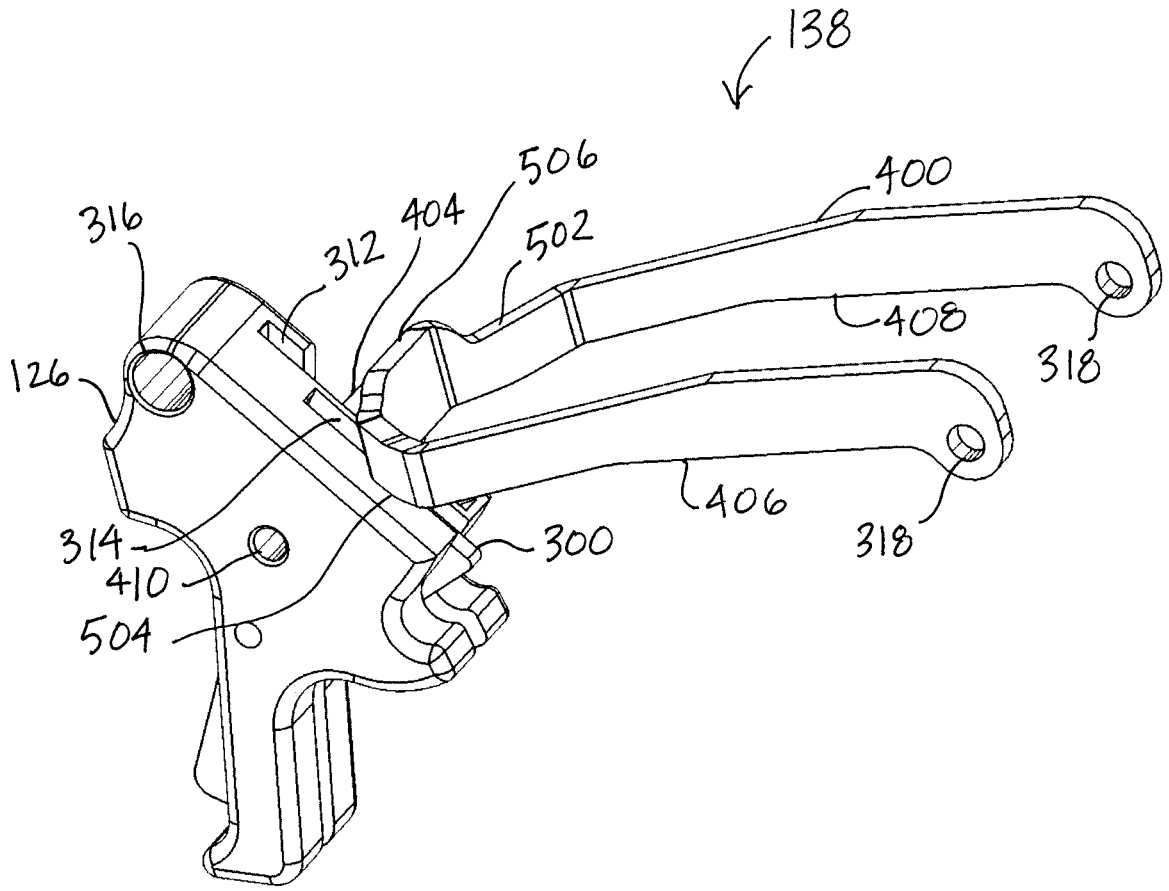
FIG. 4 is a perspective view of the trigger and trigger bar of the trigger/sear assembly.

The trigger/sear assembly shown in FIG. 4 is for a FNS/FN 509-series semi-automatic pistol manufactured by FN America. The trigger bar 138 and the trigger 126 are configured for use in the FNS/FN 509-series of pistols as properly functional replacements for the factory-supplied trigger bar 138 and trigger 126. It will be understood that while the trigger bar 138 and the trigger 126 as shown are intended for use in the FNS/FN 509-series pistols, in other embodiments the trigger bar 138 and trigger 126 may be modified for use in other semi-automatic pistol configurations.

As previously described the trigger 126 is pivotally coupled to the frame 122 via the trigger pin 154. The trigger pin hole 316 receives the trigger pin 154. The trigger 126 also includes the safety 300, which is fit within the safety slot 314 of the trigger 126. The safety slot 314 is a generally vertical slot extending from proximate to a downward end of the trigger 126, up through top and rear surfaces of the trigger 126. A portion of the safety 300 protrudes through a forward edge of the safety slot 314. The safety 300 is pivotally coupled to the trigger 126 by a safety pin (not shown).

The trigger 126 is coupled to the trigger bar 138 by the trigger bar pin (not shown). The trigger bar 138 includes the first trigger bar pin hole 302 configured to receive the trigger bar pin. The trigger 126 includes a second trigger bar pin hole 410 (shown in FIG. 4) also configured to receive the trigger bar pin, whereby the trigger bar 138 and the trigger 126 are pivotally coupled when the trigger 126 and the trigger bar 138 receive the trigger bar pin. The trigger bar 138 is a generally horizontally-oriented wishbone-shaped member, with the frontward tab 404 including the first trigger bar pin hole 302 and two parallel legs 406, 408 extending rearwards. Each leg 406, 408 includes one sear carrier pin hole 318.

The trigger bar 138 is pivotally coupled to the sear carrier 304 via the generally horizontal first sear carrier pin 308, which passes through the sear carrier pin holes 318 of the trigger bar legs 406, 408 and a hole in the sear carrier 304. A portion of the sear carrier 304 including the hole for the first sear carrier pin 308 is thus interposed between the trigger bar legs 406, 408. The sear 306 is pivotally coupled to the sear carrier 304 via the second sear carrier pin 310.

In operation, as the trigger 126 is rotated rearwards about the trigger pin 154, the trigger bar 138 is moved generally rearwards. As the trigger bar 138 moves rearwards, the pivotal connections of the trigger bar/sear carrier and a sear disconnector/sear actuate the sear 306, which releases the striker 132, thereby firing the firearm 100.

Referring next to FIG. 4, a perspective view of the trigger and trigger bar of the trigger assembly is shown. Shown are the trigger 126, the trigger bar 138, the safety 300, the trigger bar slot 312, the safety slot 314, the trigger pin hole 316, a trigger bar body 400, the first leg 406, the second leg 408, the second trigger bar pin hole 410, the trigger bar tab 404, two first sear carrier pin holes 318, a first shoulder 502, a second shoulder 504, and a connector 506.

The trigger bar 138 is pivotally coupled to the trigger 126 via the trigger bar pin (not shown), which is inserted into the first trigger bar pin hole 302 of the trigger bar 138 and into the corresponding second trigger bar pin hole 410 in the trigger 126. The trigger bar 138 is a general wishbone shape, comprising the U-shaped trigger body 400 including the first leg 406 and the second leg 408 with the short trigger bar tab 404 extending outward from the connector 506 portion of the trigger bar 138 at the base of the U-shaped trigger body 400. The trigger bar tab 404 is a thin, vertically-oriented plate section and includes the trigger bar pin hole 302 at an end of the tab 404 distal from the trigger bar body 400 (i,e. at the trigger/forward end of the trigger/trigger bar assembly). As shown in FIG. 4, the tab 404 is configured to receive the trigger bar pin, fit within the trigger bar slot 312 and rotate within the trigger bar slot 312 around a generally horizontal trigger bar pin axis of the trigger bar pin as permitted by the extent of the trigger bar slot 312. In the present embodiment, the trigger body 400 and the trigger bar tab 404 are manufactured from separate pieces of plate steel and integrally coupled together to form the trigger bar 138. In the present embodiment, the trigger bar tab 404 is rigidly coupled to the trigger bar body 400 by spot welding or other suitable type of fastening. So that the trigger bar tab 404 fits operationally within the trigger bar slot 312, a thickness of the trigger bar tab 404 is generally between 0.002" and 0.0055" narrower than a width of the trigger bar slot 312.

The base of the U-shaped trigger bar body 400 includes the connector 506 interposed between the first shoulder 502 and the second shoulder 504. The legs 406, 408 each extend rearward from one shoulder 502 504 and are generally parallel, with the leg ends at a distance as required to receive and rotate around the first sear carrier pin 308 as required for sear actuation (as shown in FIG. 3). Each leg 406, 408 end includes the sear carrier pin hole 318 configured to receive the first sear carrier pin 308.

The safety 300 is shown protruding from a rear opening of the safety slot 314. As previously described, the single trigger bar tab 404 of the trigger bar 138, installed in the offset trigger bar slot 312, provides for the separate safety slot 314 of the trigger 126 (as shown in FIGS. 3 and 4 the trigger bar slot 312 and the safety slot 314 are separated by a thin wall of the trigger 126) and improved placement of the safety 300.

Figure 5:
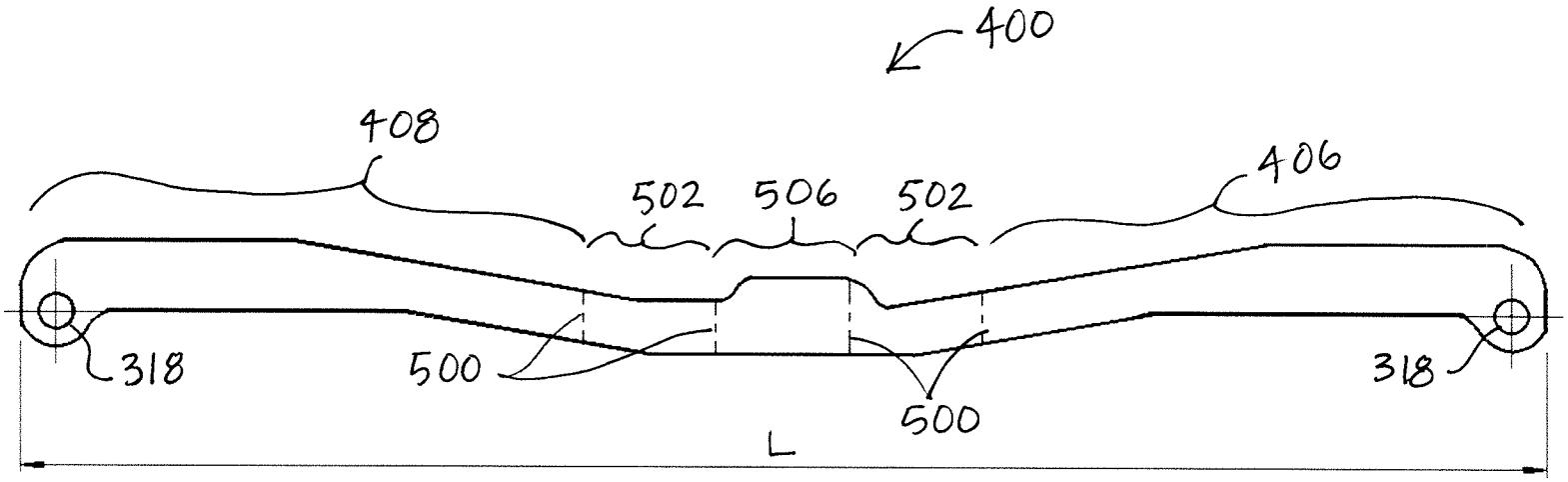
FIG. 5 is a flattened elevational view of a trigger bar body of the trigger bar.

Referring next to FIG. 5, a flattened view of an exterior face of the trigger bar body 400 is shown. Shown are the first leg 406, the second leg 408, the first sear carrier pin holes 318, a plurality of bend lines 500, the first shoulder 502, the second shoulder 504, and the connector 506.

The trigger bar body 400 in the present embodiment is manufactured by cutting and bending an approximately 0.058" thick steel plate. The trigger bar body 400 shape may be cut by any appropriate method, for example, plasma or laser cutting, or sheet metal stamping. When flattened, a trigger bar body length L in the present embodiment is approximately 4.32 inches, although the length (and other dimensions) will vary depending on the firearm manufacturer and model type. A height of the legs 406, 408 tapers slightly from the leg ends towards the connector 506, and is approximately 0.15"-0.2", not including an additional circular portion extending downward from each leg 406, 408, which is configured to accommodate the location of the sear carrier pin holes 318. The sear carrier pin holes 318 are configured to couple to the first sear carrier pin 308, as previously shown in FIG. 3.

Figure 7:
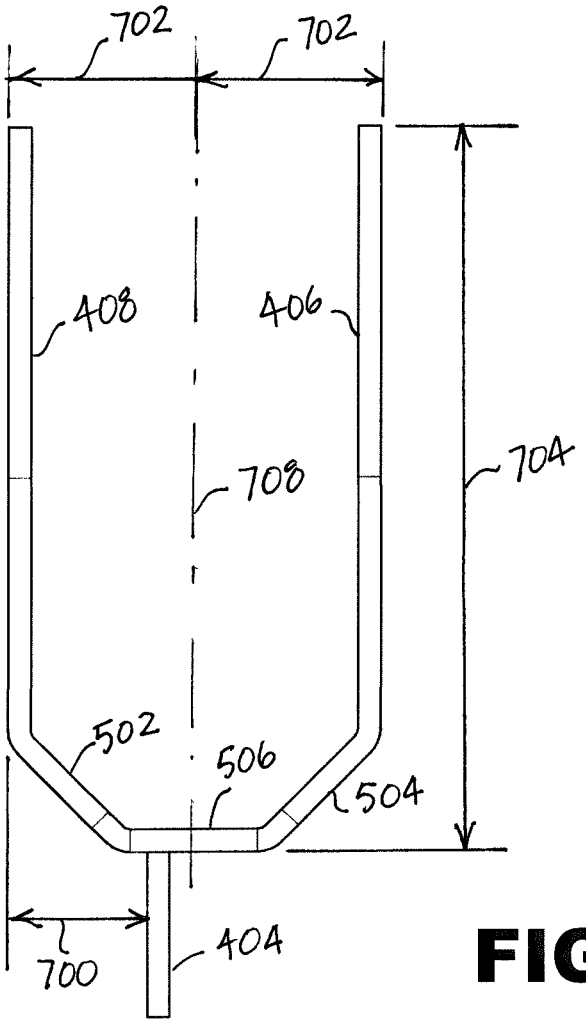
FIG. 7 is a plan view of the trigger bar.

A center portion (i.e. the base of the U-shape) of the trigger bar body 400 includes the connector 506 interposed between the first shoulder 502 and the second shoulder 504. The center portion is itself interposed between the first leg 406 and the second leg 408. The four bend lines 500 mark the general locations where the trigger bar body 400 is bent to form the U-shape. Bend lines 500 are located at approximately the leg-shoulder boundaries and the shoulder-connector boundaries for a total of four bend lines 500. The connector 506 is approximately 0.225" high at its highest point and approximately 0.45 inches wide. The trigger bar tab 404 is coupled to the center portion such that the trigger bar tab 404 is offset with respect to a location equidistant to each leg 406, 408 so that the trigger bar 138 fits properly in both the offset trigger bar slot 312 of the trigger 126 and on the sear carrier pins 308 (as shown in FIG. 7).

When bent on the bend lines 500, the trigger bar body 400 forms the general U-shape as shown in FIGS. 2-4, with the shoulders 502 504 at approximately 45 degree angles with respect to the connector 506 and connecting legs 406, 408. The legs 406, 408 are generally parallel after bending. The trigger bar body geometry is configured to avoid interference with the frame 122 and other internal components, in particular the slide stop lever 144. It will be understood that the specific dimensions will vary depending on configuration of the trigger bar 138 for use in various firearm makes and models.

Figure 6:
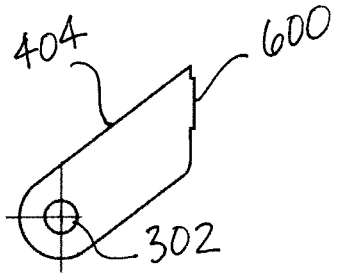
FIG. 6 is an elevational view of a trigger bar tab of the trigger bar.

Referring next to FIG. 6, a side elevational view of the trigger bar tab 404 is shown. Shown is the trigger bar pin hole 302 and a trigger bar tab projection 600.

The trigger bar tab 404 is also manufactured from a plate of metal, typically of the same type as the trigger bar body 400. The plate thickness is approximately 0.058 inches. The trigger bar tab 404 is oriented in an upward angle of approximately 37 degrees from the trigger bar pin hole (downward) end, so that when the trigger bar tab 404 is coupled to the trigger bar body 400 the trigger bar tab 404 extends downward and away from the connector 506 at an angle of approximately 37 degrees. A portion of the trigger bar tab 404 includes the trigger bar tab projection 600, a short extension of a portion of the trigger bar tab 404 where the trigger bar tab 404 attaches to the trigger bar body 400. In the present embodiment, the trigger bar tab projection 600 is used to provide extra filler material for spot welding purposes. In other embodiments the trigger bar tab projection 600 may be eliminated, whereby a fillet weld is used around the trigger bar tab 404, or the trigger bar tab projection 600 may be extended and inserted into a corresponding hole in the trigger bar body 400.

Referring next to FIG. 7, a plan view of the trigger bar 138 is shown. Shown are the trigger bar body 400, the first leg 406, the second leg 408, the trigger bar tab 404, a trigger bar tab offset 700, a trigger bar leg center distance 702, a trigger bar length 704, and a trigger bar centerline 708 are shown.

When viewed in plan, the U-shape of the trigger bar body 400 is visible, with the trigger bar tab 404 extending downward as shown (forward with respect to the firearm 100) from the connector 506. As shown in FIG. 7 and previously described, the legs 406, 408 are generally parallel. The trigger bar tab 404 is also generally parallel to the legs 406, 408 when viewed in plan. The centerline 708 of the trigger bar 138 is defined as a line equidistant from both legs 406, 408 (i.e. the trigger bar leg center distances 702, the distance between the centerline 708 and an outer face of one leg 406, 408, are equal). As viewed in FIG. 7, a distance between an outer (right-side with respect to the previously defined directions) face of the second leg 408 and a right-side face of the trigger bar tab 404 is the trigger bar tab offset 700. As previously described, the trigger bar tab 404 is offset from the centerline 708 of the trigger bar body 400 so that the trigger bar tab 404 fits within the offset trigger bar slot 312 of the trigger 126 but the trigger bar 138 still properly aligns with the trigger 126 and the sear carrier 304. In the present embodiment, the trigger bar tab offset 700 is approximately 0.365".

In the present embodiment, the trigger bar leg center distance 702 is approximately 0.487". The trigger bar length 704 is the distance from the outer surface of the connector 506 to the rear extent of the legs 406, 408. In the present embodiment, the trigger bar length 704 is approximately 1.91".

While the invention herein disclosed has been described by means of specific embodiments, examples and applications thereof, numerous modifications and variations could be made thereto by those skilled in the art without departing from the scope of the invention set forth in the claims.

What is claimed is:

1. A trigger assembly for a semi-automatic firearm comprising:

a trigger having a centerline, wherein the trigger is configured such that the trigger centerline aligns with a centerline of a frame of the firearm when the trigger is installed in the firearm, the trigger including a trigger bar hole, a trigger bar slot, and a safety slot generally parallel to the trigger bar slot, wherein the trigger bar slot and the safety slot are separated by a wall and wherein the trigger bar slot is offset from a centerline of the trigger;

a trigger bar comprising:

a continuous U-shaped body having a straight connector base portion and two rear legs coupled to and generally perpendicular to the connector base portion, the body having a centerline located equidistantly from each leg, wherein each leg is configured to operatively couple to a sear assembly of the firearm; and a tab oriented generally parallel to the centerline and extending forward from the straight connector base portion at a location offset from the centerline, and inserted within the trigger bar slot of the trigger, the tab including a trigger bar pin hole at an end of the tab distal to the straight connector base portion, the trigger bar pin hole; and a trigger bar pin received by the trigger bar hole and the trigger bar pin hole, whereby the trigger is pivotally coupled to the trigger bar such that the centerline of the trigger aligns with the trigger bar body centerline, whereby the trigger bar is functional for firing of the firearm when the only connection of the trigger to the trigger bar is via the tab.

2. The trigger assembly for the semi-automatic firearm of claim 1, wherein the trigger bar is configured for use with at least one of a group of handguns designed by FN America and designated one of FNS and FN 509, including a 9 mm and a .40.

3. The trigger assembly for the semi-automatic firearm of claim 1, wherein the tab is made separately from the body and then coupled to the body.

4. The trigger assembly for the semi-automatic firearm of claim 1, wherein the body and the tab comprise metal.

5. The trigger assembly for the semi-automatic firearm of claim 4, wherein the body and the tab of the trigger bar comprise steel.

6. The trigger bar assembly for the semi-automatic firearm of claim 4, wherein the body and the tab of the trigger bar comprise one of C1010 and C1018 steel.

7. The trigger bar assembly for the semi-automatic firearm of claim 1, wherein the tab is made from a single plate.

8. The trigger assembly for the semi-automatic firearm of claim 7, wherein the tab has a thickness that is between 0.002" and 0.0055" narrower than the trigger bar slot of the firearm.

9. The trigger assembly for the semi-automatic firearm of claim 7, wherein the plate has a thickness of approximately 0.058".

10. The trigger assembly for the semi-automatic firearm of claim 1, wherein a distance between a right-side face of the tab and a right-side face of the leg proximate to the tab is approximately 0.365".

* * * * *